US010731550B2

(12) United States Patent
Kuhlmann

(10) Patent No.: US 10,731,550 B2
(45) Date of Patent: Aug. 4, 2020

(54) POWER SUPPLY UNIT, POWER SUPPLY ASSEMBLY, AND WATER VEHICLE HAVING A POWER SUPPLY UNIT OR HAVING A POWER SUPPLY ASSEMBLY

(71) Applicant: BECKER MARINE SYSTEMS GMBH & CO. KG, Hamburg (DE)

(72) Inventor: Henning Kuhlmann, Hamburg (DE)

(73) Assignee: becker marine systems GmbH Co. KG, Hamburg (DE)

( * ) Notice: Subject to any disclaimer, the term of this patent is extended or adjusted under 35 U.S.C. 154(b) by 8 days.

(21) Appl. No.: 14/903,257

(22) PCT Filed: Jul. 14, 2014

(86) PCT No.: PCT/EP2014/065056
§ 371 (c)(1),
(2) Date: Jan. 6, 2016

(87) PCT Pub. No.: WO2015/004288
PCT Pub. Date: Jan. 15, 2015

(65) Prior Publication Data

US 2016/0160752 A1 Jun. 9, 2016

(30) Foreign Application Priority Data

Jul. 12, 2013 (DE) ..... 20 2013 103 128 U

(51) Int. Cl.
*F02B 63/04* (2006.01)
*B63J 3/04* (2006.01)
*B63B 25/00* (2006.01)

(52) U.S. Cl.
CPC ..... *F02B 63/048* (2013.01); *B63J 3/04* (2013.01); *B63B 25/004* (2013.01)

(58) Field of Classification Search
CPC ..... F02B 63/048; B63J 3/04
See application file for complete search history.

(56) References Cited

U.S. PATENT DOCUMENTS 3,602,730 A * 8/1971 Cushing ..... B63J 3/04 114/72
8,495,869 B2 * 7/2013 Beissler ..... F01N 13/00 60/274

(Continued)

FOREIGN PATENT DOCUMENTS

DE 10336792 A1 3/2005
EP 1426307 A1 6/2004

(Continued)

OTHER PUBLICATIONS

Japanese Office Action for the Japanese application No. 2016-524846 dated Apr. 2, 2019.

*Primary Examiner* — Viet P Nguyen
(74) *Attorney, Agent, or Firm* — Kelly & Kelley, LLP

(57) ABSTRACT

The invention relates to transportable and compact power supply unit for supplying a water vehicle, in particular an electrical power supply system of the water vehicle, with electrical energy and in particular for arrangement on the water vehicle, containing in a transport container or a plurality of transport containers that can be connected together, wherein the transport container or the plurality of transport containers can be transported as a single, coherent unit: at least one internal combustion engine that can be operated on gas, in particular a natural gas, at least one generator for generating power, which can be driven by the at least one internal combustion engine, at least one control device for the at least one internal combustion engine and/or at least one control device for the at least one generator, at least one fuel treatment device for the at least one internal combustion engine and/or at least one exhaust gas cleaning device for the at least one internal combustion engine, and at least one fuel storage device, wherein the fuel of the fuel storage device is a gas, in particular a natural gas, which is (Continued)

present preferably as liquefied gas, especially preferably as LNG.

12 Claims, 7 Drawing Sheets

(56) References Cited

U.S. PATENT DOCUMENTS

| | | | | |
|---|---|---|---|---|
| 2010/0025409 | A1* | 2/2010 | Hunter | F02B 77/13<br>220/567.2 |
| 2010/0308648 | A1* | 12/2010 | Krackhardt | F02B 63/04<br>307/9.1 |
| 2012/0102929 | A1* | 5/2012 | Beissler | F01N 13/00<br>60/297 |

FOREIGN PATENT DOCUMENTS

| | | | |
|---|---|---|---|
| JP | S59-130031 | U | 8/1984 |
| JP | H2-70924 | A | 3/1990 |
| JP | 2006-97583 | A | 4/2006 |
| JP | 2013-95257 | A | 5/2013 |

* cited by examiner

POWER SUPPLY UNIT, POWER SUPPLY ASSEMBLY, AND WATER VEHICLE HAVING A POWER SUPPLY UNIT OR HAVING A POWER SUPPLY ASSEMBLY

RELATED APPLICATIONS

This is a United States National Application of PCT/EP2014/065056 (published as WO2015/004288A1), which claims priority to German Patent Application 202013103128.3, filed Jul. 12, 2013.

The invention concerns a transportable, compact power supply unit, a power supply assembly, and a water vehicle having a power supply unit and/or having a power supply assembly.

PRIOR ART

From the publication DE 10 2008 031 698 A1 a buoyant in-port power supply—a so-called "power barge"—is of known art. In accordance with the disclosure in this publication energy supply components, or also other supply or disposal equipment can be assembled together in a modular manner on a barge or lighter, so that the barges can be configured in accordance with the desired purpose. The components, or modules, are preferably designed as transport containers. The task is that of preventing the formation of soot and carbon dioxide by ships berthed in port, in particular seagoing ships, in that the latter, instead of producing their own energy using the on-board ship machinery, are now supplied with power in an environmentally friendly manner from the "power barge", to which end the latter uses LNG as fuel. The individual components of the in-port power supply described are combined in any desired variation and loaded on to the lighter. A lighter equipped in this manner can be used for various supply and disposal tasks. What is disadvantageous in the case of such "power barges" is the need to provide a separate berth for the lighter and a cable connection between the lighter and the ship that is being supplied.

In the publication DE 103 36 792 A1 an energy generation device is presented, in which a generator, together with a gas turbine driving the latter, is accommodated in a standard container. Further standard containers contain supply air and exhaust air equipment, cooling equipment, electrical power and control equipment, a fuel module and a fuel tank. The containers can be transported separately, and are joined together for operating the energy generation equipment. Light fuel oil is preferably provided for operation of the gas turbine. This energy generation equipment is used for purposes of energy supply on offshore platforms and ships, in particular on reefer container ships. A particularly low-pollutant operation is not referred to or provided in the presentation of this publication. Also it appears that the assembly and disassembly of the described energy generation equipment are too complex for frequent movement from one location or operating site to another, and that the energy generation equipment in its assembled ready-for-use state has an inconvenient, bulky configuration, which makes its deployment difficult and inflexible.

The publication U.S. Pat. No. 7,122,913 B2 describes a modular power supply whose components are accommodated in a transportable manner in a standard container. The container contains an engine operated with a fuel, a generator, an electrical control system, and a cable drum. The fuel tank is situated separately. The power supply is provided for reducing air contamination to take over the energy supply of ships berthed in port or in dock. For this purpose an installation of the power supply on land, e.g. in the dock, or on the quay, is described and the power supply can be moved and transported with the aid of a crane, a forklift truck, or a lorry. Here the need ensues to provide a separate installation site for the power supply on the one hand and the fuel tank on the other hand, and a cable connection between the power supply and the ship that is to be supplied.

In the publication U.S. Pat. No. 3,602,730 is described a transportable power supply installed in a freight container for providing the electrical energy for a number of other freight containers, e.g. reefer containers, on board of a container ship. In this manner the power supply for a sea voyage, together with the freight containers that are to be supplied, can be stowed on or below deck. In summary, the power supply in each container contains at least one diesel engine, at least one generator coupled with the latter, and at least one integral fuel tank, and is provided for energy supply to the freight container during a sea voyage, but not for connection to the on-board electrical power supply system of the container ship. By this means a more effective power supply to the freight container can be obtained than is possible by connecting the said freight containers to the on-board electrical power supply system of the container ship. The integral fuel tanks are dimensioned such that the fuel supply is sufficient for the sea voyage. In the case of the power supply as described the refuelling process for operation as an in-port power supply is too cumbersome. Also the diesel fuel no longer fulfils the more demanding environmental requirements for operation in port.

The publication WO 2010 019 158 A1 shows an energy generation module, accommodated in an ISO container and positioned on a railway wagon chassis; the module comprises the engine, generator, fuel tank and power interface connection. Here loading onto a railway wagon is preferred on account of the high weight of the energy generation module. The fuel can be supplied from an externally connected tank wagon.

Presentation of the Invention: Task, Solution, Advantages

The invention has the task of creating a power supply unit, which can be handled more easily, more rapidly and more flexibly, and thus offers greater operating convenience, in particular when deployed on ships, preferably container ships.

The said task is solved by means of a transportable and compact power supply unit for supplying a water vehicle, in particular an on-board electrical power supply system of the water vehicle, with electrical energy and in particular for arrangement on the water vehicle, containing in a transport container, or a plurality of transport containers that can be connected together, wherein the transport container, or the plurality of transport containers, can be transported as a single, coherent unit:

at least one internal combustion engine, which can be operated on gas, in particular a natural gas, at least one generator for generating power which can be driven by the at least one internal combustion engine, at least one control device for the at least one internal combustion engine and/or at least one control device for the at least one generator, at least one fuel treatment device for the at least one internal combustion engine, and/or at least one exhaust gas cleaning device (109; 209) for the at least one internal combustion engine, and at least one fuel storage device, wherein the fuel of the fuel storage device is a gas, in particular a natural gas, which is preferably present as a liquefied gas, particularly preferably as LNG.

By means of the invention a power supply unit is thus created, which is designed for supplying a water vehicle, in particular an on-board electrical power supply system of the water vehicle, with electrical energy. Furthermore the power supply unit can preferably be arranged, i.e. installed, directly on board the water vehicle that is to be supplied with electrical energy. If further loads outboard the water vehicle are also to be supplied with electrical energy from the power supply unit, it is advantageous for the power supply unit to be installed on the water vehicle that is primarily to be supplied with energy, i.e. with at least the predominant proportion of the energy delivered by the power supply unit. In this manner complex connections outboard of the said water vehicle are avoided. Preferably a single water vehicle is exclusively supplied with power, as is also described in the following. In principle it would also be possible for the power supply unit to be designed for the additional purpose of supplying consumer loads external to water vehicles.

In the context of the present invention in general a water vehicle is understood to be any unit or facility located on the water, or provided, that is to say designed, for residence on or in the water, preferably floating, but also fixedly located, that is, e.g. a ship, but also an offshore platform, among other examples; it designates in particular a seagoing ship, particularly preferably a seagoing container ship, or container ship, wherein the examples that have been mentioned are under no circumstances to be understood as exhaustive.

In the present context, in principle any load-carrying structure suitable for carrying the components of the power supply unit falls under the term "transport container". These can preferably be containers or freight containers, or load-carrying structures in the form of containers or freight containers, which in particular are deployed in container shipping. The transport containers can be closed containers or other forms of containers. However, the term "transport container" also comprises open, or partially open, load-carrying structures, such as, for example, load-carrying frames which have no cladding, or only partial cladding. Also, in the case of a plurality of transport containers, transport containers of different configurations or the same configuration can be combined with one another. Particularly advantageous transport containers in the current context are those containers that are usually deployed for transporting goods on container ships, or that have at least the dimensions, or at least some of the dimensions, of the containers usually deployed on container ships, in particular standardised containers, such as ISO containers. In the current context the term "standardised transport container" is to be understood as being a load-carrying structure that has the dimensions of standardised containers, particular for container shipping. With regard to the base surface area, the height, or a combination of both, the dimensions can correspond with those of the standardised containers.

Furthermore, the individual above-cited components of the power supply unit are arranged within one transport container, or within a plurality of transport containers connected with one another. The one transport container, or the plurality of transport containers connected, in particular undetachably, with one another, are thereby designed such that they can be transported as a single, coherent unit. The plurality of transport containers are connected with one another, at least during transport, such that as a single unit they can be transported as a whole. The plurality of transport containers are preferably also connected with one another, particularly preferably permanently, during operation. The transport container and/or the plurality of transport containers are preferably designed such that they can be transported with standardised lifting equipment, in particular standardised lifting equipment for container ports, such as container bridges and/or van carriers.

In particular, the one transport container, or the plurality of transport containers connected with one another, form a single unit, which as a whole can be or is transported onto the water vehicle, or to another destination, is there set down and operated, and after it has been taken out of operation is again removed as a whole from the water vehicle and is set down, e.g., on a port quay, until its next deployment. As the components are arranged within one transport container or within a plurality of transport containers connected with one another, the power supply unit is designed in a compact manner. The whole power supply unit is preferably exclusively arranged within the transport container or within the plurality of transport containers connected with one another.

In the power supply unit any type of engine that can be operated on gas, for example a gas turbine or similar, can be used as the internal combustion engine. The internal combustion engine can preferably be operated exclusively with gas. In principle, however, embodiments are possible in which the internal combustion engine is equipped for dual fuel operation, in which the internal combustion engine can be operated on gas and, in addition, on another fuel, in particular diesel. In particular the internal combustion engine can be operated on natural gas. Furthermore the internal combustion engine can preferably be operated on liquefied gas, particularly preferably on LNG (so-called "liquid natural gas"). Accordingly, low-emission fuels are preferably deployed.

The power supply unit is preferably designed as a combined heat and power unit (abbreviated: CHP) as a result of which a very economical fuel consumption and a high overall efficiency can be achieved for the power supply unit, since apart from the generated electrical energy in addition the exhaust heat from the internal combustion engine can also be delivered as thermal energy to the consumer load of the generated electrical energy, or to another consumer load.

The invention thus enables simple and cost-effective operation together with a simplification, acceleration and flexibilisation of the handling and transport of the power supply unit, and thus offers greater operating convenience, in particular when deployed on water vehicles, preferably on ships, particularly preferably on container ships.

Other possible components of the power supply unit are, for example, a cooling device, in particular for generating a cooling circuit for the internal combustion engine, advantageously comprising a fan, a control cabinet, in which in particular the control device of the internal combustion engine and/or the control device of the generator are arranged, means for adjusting the frequency, the amperage and/or the voltage, a supply air system for the supply of combustion air to the internal combustion engine, fire-extinguishing equipment, batteries, in particular for the intermediate storage of the generated power, an exhaust gas system, and/or means for storage of electrical cables, in particular a cable drum. The exhaust gas cleaning device can advantageously comprise a noise attenuator. The cable drum can comprise a plurality of, in particular two, cables.

Further advantageous configurations of the invention are identified in the dependent claims.

In a preferred form of embodiment the power supply unit comprises a first structural unit forming a fixed unit, and at least one second structural unit forming a further fixed unit, wherein the first structural unit in summary in particular contains the at least one internal combustion engine, the at least one generator for generating power which can be driven by the at least one internal combustion engine, the at least one control device for the at least one internal combustion engine, and/or the at least one control device for the at least one generator, and the at least one fuel treatment device for the at least one internal combustion engine, and/or at least one exhaust gas cleaning device for the at least one internal combustion engine, and wherein the second structural unit contains the at least one fuel storage device.

In the present context a structural unit—forming a fixed unit—(in operation, both for transport and handling) represents an undetachably connected unit, which as a whole, in particular is transported onto the water vehicle, is there set down, and operated, and after being taken out of operation, is also removed as a whole once again from the water vehicle, and set down e.g. on a port quay until the next deployment. In order to obtain a simplified design and standardised construction at a reduced price, for example, such a structural unit can also consist of a permanently connected group of containers, in particular transport containers, wherein the term "permanent" here means that this group of containers always remains connected for operation, transport and handling. Thus structural units, in the sense of the word used here, are structures that cannot be further disassembled in a modular manner for operation, transport and handling, as will be also further explained in the following, but rather always form a single fixed, unaltered unit for operation, transport and handling. However, this does not exclude the possibility that connections of the containers in the cited group of containers can in principle be embodied such that they can be detached. Thus two, or a plurality, of the containers can be welded together to form the cited group, but can also be e.g. bolted together, however, a detachment of such bolted joints is not provided in the intended operation and transport or handling of the power supply unit, but would be intended at most for maintenance and repair purposes.

In accordance with the preferred form of embodiment two structural units are provided for forming the power supply unit, and for this purpose also not more than these two structural units are required. As a result, operation, transport and handling of the power supply unit are significantly simplified. In a preferred variant the first and the second structural unit are configured such that in operation, and/or for transport and handling, they can be detached from one another and can be docked onto one another.

In one variation, in addition to the first structural unit e.g. two or a plurality of second structural units can also be provided, each of which has a fuel storage device. In this variation during the operation of the power supply unit it is, e.g., simply possible to exchange one of the two structural units, e.g. in order to replace an empty fuel storage unit with a freshly filled fuel storage unit, while the power supply unit continues to be operated from the fuel storage unit in the other second structural unit. However, it can also be advantageous to provide just one first structural unit and one second structural unit, i.e. no further additional structural units.

The first and the at least one second structural unit are arranged together in a transport container or in a plurality of transport containers that can be connected with one another.

In the context of the present invention the term "docking" indicates the establishing of a mechanical and functional connection between two structural units. The structural units, which in this sense are docked together, are coupled or connected with one another in a mechanically robust manner for a foreseeable period of time, in particular for a period of time in which operation of the power supply unit is to be undertaken. Moreover, by means of the docking process operative connections can advantageously be made, such as, in particular, electrical, hydraulic, pneumatic or other forms of interface connections, passages for personnel, and similar. In particular, the docking process preferably also comprises the establishing of a connection between the at least one internal combustion engine in the first structural unit and the at least one fuel storage device in the second structural unit for purposes of supplying the at least one internal combustion engine with fuel from the at least one fuel storage device.

Here it is particularly advantageous that the second structural unit, comprising the fuel storage device, can easily be detached from the first structural unit if the fuel storage device is empty. Similarly, in a simple manner a further second structural unit with a full fuel storage device can be docked once more onto the first structural unit. In this respect the supply of fuel during power generation can take place, in particular exclusively, by the exchange of the second structural units with the fuel storage devices. Alternatively, however, the fuel storage devices can also be refilled from external tanks, e.g. mounted on lorries. This is especially useful in the case of embodiments in which the first and the second structural units are connected with one another in a fixed and non-detachable manner.

Some or all of the possible other components of the power supply unit, in particular the cooling device, the control cabinet, the means for adjusting the frequency, the amperage and/or the voltage, the supply air system, the fire-extinguishing equipment, the batteries, the exhaust gas system, and/or the means for storage of electrical conductors, are advantageously arranged in the first structural unit. The second structural unit preferably comprises exclusively the at least one fuel storage device, and no other additional components of the power supply unit.

In accordance with a preferred development of the power supply unit, the structural units are configured both individually and also, if required, when both are docked together, in standardised transport containers with predetermined grid stowage dimensions.

Here the term "grid stowage dimension" indicates a uniform grid dimension, in which standardised transport containers are stowed on a means of transport, here a water vehicle, in particular a ship, and compatible to which standardised reception facilities are provided on this means of transport, such as e.g. mounting fixtures, shafts, platforms for the stowage of transport containers of only particular dimensions (for example, a particular base surface area, or a particular height, if required in combination with a particular base surface area). Such a grid stowage dimension represents, where appropriate, a limited selection from a number of grid dimensions in which the cited standardised transport containers can in principle be available.

The structural units of the power supply unit can then be stored with other transport containers of the same grid dimension together, or at least sitting on top of one another, can fit into the standardised reception facilities, such as e.g. mounting fixtures, shafts, platforms, for stowing transport containers, i.e. in container mounting fixtures on the means of transport, here the water vehicle, in particular on the ship, and can there, according to need, be set down at any point or can be moved simply, quickly and securely as is desirable or necessary for the supply of energy to the water vehicle, i.e. of the means of transport, or for a loading task and/or an unloading task.

Here in accordance with a further configuration of the power supply unit the grid stowage dimensions of ISO transport containers are particularly preferably selected as the predetermined grid stowage dimensions.

In accordance with this configuration the first and the second structural units, both individually and also, if required, when both are docked together, are therefore advantageously configured in the predetermined grid stowage dimensions of ISO transport containers. Due to the extensive worldwide distribution of such transport containers and means of transport or handling that are matched to these, a power supply unit configured in this manner can be deployed flexibly and universally.

In a further preferred form of embodiment of the power supply unit the first structural unit comprises a first compartment, which has the configuration of an, in particular standardised, transport container with a length dimension that corresponds to a first grid stowage dimension and in which are arranged at least the at least one internal combustion engine and the at least one generator for generating power which can be driven by the at least one internal combustion engine. The said first compartment is preferably directly formed by such a standardised transport container, particularly preferably an ISO transport container, as a result of which a simple, rapid, proven and cost-effective manufacture ensues. Moreover, by this means good stowability, together with flexible handling in transport and operation, is ensured.

In accordance with one preferred development of the power supply unit, the second structural unit, in which the at least one fuel storage device is arranged, has the configuration of a standardised transport container with a length dimension that corresponds to a second grid stowagedimension. In this manner it is ensured that the second structural unit in itself, that is to say separately from the first structural unit, can also be simply, quickly, flexibly and securely handled, transported and stowed; also the manufacture of the second unit by means of a production method adopted and tested for the standardised transport containers becomes simply, quickly and cost effectively possible, in particular in that, particularly advantageously the second structural unit is directly formed by means of such a standardised transport container, particularly preferably by an ISO transport container.

In accordance with a further preferred configuration of the power supply unit the first structural unit comprises a second compartment, which has the configuration of a standardised transport container with a length dimension that corresponds to a third grid dimension, and in which is preferably arranged at least the at least one fuel treatment device, and/or the at least one exhaust cleaning device for the at least one internal combustion engine, and/or a cooling device for cooling the internal combustion engine, and/or a means of storage for electrical conductors, in particular a cable drum.

The first and the second compartments of the first structural unit are thereby preferably permanently connected in the above described manner, i.e. forming a fixed unit, that is to say, they cannot be further disassembled in a modular manner for transport, handling and operation, and are thus always transported, handled, and operated together. The third grid dimension can, but need not, be a third grid stowage dimension according to the definition of the term given above, whereby standardised transport containers are produced and authorised in a number of grid dimensions; of the totality of these grid dimensions, however, only a limited selection come into use as grid stowage dimensions in which transport containers are stowed on the means of transport. This ensures the advantages cited in production also for the second compartment of the first structural unit; the second compartment can e.g. at first be produced separately as a standardised transport container, and can then be permanently connected with the first compartment in the manufacture of the first structural unit. Moreover, in the context of the production of the second compartment it is also preferably fitted out at the same time with the at least one fuel treatment device, and/or the at least one exhaust cleaning device for the at least one internal combustion engine, and at first only the compartments that are, at least to a large extent, pre-assembled, are joined together, which produces a further simplification of production.

In a further preferred form of embodiment of the power supply unit the second compartment is arranged above the first compartment. In particular the second compartment is positioned on top of the first compartment. With conventional dimensions and weights of the components of the power supply unit arranged in the individual compartments a favourable centre of gravity and a mechanically stable and secure embodiment of the first structural unit are obtained.

In accordance with a preferred development of the power supply unit, the second structural unit can be arranged alongside the second compartment of the first structural unit, and preferably the sum of the second grid stowage dimension and the third grid dimension is less than, or equal to, the first grid stowage dimension. In this manner a total length of the second structural unit and the second compartment of the first structural unit, after the docking of the second structural unit onto the first structural unit, is at most, and is preferably exactly the same as, the length of the first compartment of the first structural unit. Thus, with the docking process one obtains a closed, compact overall measurement, which ensures simple and flexible handling of the power supply unit. The same advantage ensues if the second structural unit is not detachable and dockable, but rather is designed to be permanently connected with the first unit.

A self-contained power supply unit is advantageously obtained according to the above configurations in an assembly of standardised transport containers, in which the at least one internal combustion engine, preferably one engine, together with the at least one generator for generating power, are accommodated in a first container serving as a base unit, which forms the first compartment of the first structural unit, and which in a preferred example is a 40-foot container in accordance with the ISO standard. In a second container arranged upon the first, preferably a 20-foot container in accordance with the ISO standard, which is securely connected with the first container, and forms the second compartment of the first structural unit, a so-called "gas processing unit" (GPU) is installed as a preferred example of the at least one fuel treatment device, and/or the at least one exhaust gas cleaning device for the at least one internal combustion engine. The space remaining free on the first container is then intended for a third container, which can be arranged there such that it can be replaced, forms the second structural unit, and contains a tank for fuel. In this embodiment the second structural unit with the tank for the fuel is arranged asymmetrically on the first structural unit. The GPU preferably comprises a vaporiser device.

This embodiment particularly well enables the whole power unit, or also the individual units, to be configured such that they can be lifted by crane and moved with standardised equipment such as e.g. a container bridge, a van carrier, or similar, and for purposes of operation on the water vehicle, e.g. a ship, preferably a container ship, can be set down in a container mounting fixture there present.

In accordance with a another form of embodiment of the power supply unit the first structural unit comprises a second compartment, subdivided into two or a plurality of subcompartments, wherein each of the subcompartments in itself has the configuration of a preferably standardised transport container with a length dimension that corresponds to a fourth, fifth, etc. grid dimension, and wherein in at least one of the subcompartments is preferably arranged at least the at least one fuel treatment device, and/or the at least one exhaust cleaning device for the at least one internal combustion engine, and/or a cooling device for cooling the internal combustion engine, and/or a means of storage for electrical conductors, in particular a cable drum.

In this division into two parts of the second compartment for the properties and advantages of each of the subcompartments the statements made relating to the single-part second compartment apply. Here the fourth, and/or the fifth or, if required, further grid dimension can again be grid stowagedimensions, i.e. a fourth or a fifth grid stowage dimension, but this is not obligatory.

In accordance with a preferred development of the power supply unit, the first compartment and the subcompartments of the second compartment of the first structural unit are connected with one another, forming a fixed unit, as is also undertaken in the case of a single-part second compartment. Furthermore, the subcompartments of the second compartment are advantageously arranged above the first compartment, so that here too a high mechanical strength and a favourable centre of gravity ensue. The second structural unit can particularly be arranged between the subcompartments of the second compartment of the first structural unit, and preferably the sum of the second, fourth and fifth grid stowage dimensions is less than, or equal to, the first grid stowage dimension.

In this embodiment the second structural unit is advantageously arranged with the at least one fuel storage device, i.e. the tank for the fuel, essentially, that is to say at least approximately, centrally, that is to say symmetrically, on the first compartment of the first structural unit and thus of the whole power supply unit, flanked on both sides in each case by at least one of the subcompartments of the second compartment of the first structural unit. In an alternative preferred form of embodiment the second structural unit is arranged eccentrically on the first compartment of the first structural unit, as a result of which the one or more subcompartments on one side of the second structural unit are narrower than the one or more subcompartments on the other side of the second structural unit. In this manner the individual components of the power supply unit can, for example, be arranged relative to one another such that the conductors connecting the components with one another can be as short as possible, so that the space requirement for these is as small as possible. In this context it is particularly advantageous to arrange a connector device for the fuel storage device alongside, or above, or below a fuel treatment device.

Furthermore, in the case of both alternative forms of embodiment it is particularly advantageous if the first structural unit on its own, without the second structural unit docked to it, can be simply, universally and securely stacked with other standardised transport containers, in particular, such with matching grid stowage dimensions. For example, the two subcompartments of the second compartment of the first structural unit are in each case designed to be smaller than 20-foot containers, in particular, are designed as approximately 10-foot containers, i.e. the fourth and the fifth grid dimensions amount to less than 20 feet each, in particular are 10 feet each, and the first compartment of the first structural unit is again formed as a 40-foot container in accordance with the ISO standard. The two smaller (in particular 10-foot) containers are arranged on the 40-foot container, in each case flush with one of the ends of the latter, so that a space remains between them for a second structural unit in the form of a 20-foot container. Independent of the presence of such a second structural unit in the form of a 20-foot container, further 40-foot containers can be set down on the first structural unit in any manner within the limits of the permissible stacking height as conditioned by loading; also possible is the setting down of, e.g., a further 40-foot container and on top of that, e.g. two 20-foot containers or other combinations. The above-cited containers are transport containers in the context of the present invention, i.e. they are load-carrying structures, which have the dimensions cited. The same is also true for containers with a dimensional designation quoted below.

In accordance with another form of embodiment of the power supply unit a connector device, in particular, one that can be plugged in, and/or is designed in the form of a coupling, is provided for transferring fuel from the at least one fuel storage device of the second structural unit to the first structural unit, wherein the pluggable connector device is designed for the at least semi-automatic establishing of a connection for the transfer of fuel, in particular when the second structural unit is docked onto the first structural unit. The connection concerned is preferably designed in the form of a flexible hose coupling. Such a connection can be formed fully automatically during the docking process, but can also be made by operating personnel during (partially) manual operation. Alternatively or additionally, for establishing the docking between the first and second structural units, the power supply unit can comprise a coupling device, in particular a dry coupling. The coupling device can also comprise valves.

In accordance with another form of embodiment of the power supply unit fuel can be supplied exclusively from the fuel storage device to the at least one internal combustion engine. Here the second structural unit preferably serves exclusively as the fuel source; in this form of embodiment further fuel sources are not required for the operation of the power supply unit, and also are specifically not used. In this manner in the case of the isolated operation of the power supply unit embodied in this manner, no further cable connections are required for supplying fuel to the power supply unit, either on-board, or off-board the water vehicle. This also simplifies the operation of the power supply unit.

A further embodiment of the power supply unit is advantageously characterised by electrical means of connection, arranged in particular in the first structural unit, for connecting the power supply unit with at least one on-board electrical power supply system of the water vehicle that is to be supplied, forming a consumer load for the electrical energy generated in the power supply unit. The said electrical means of connection are preferably formed by a cable drum with a connecting cable arranged in the first compartment of the first structural unit. In particular, for achieving power cables that are as short as possible, the cable drum is arranged in the vicinity of the at least one generator for generating power. Carrying along the said means of connection in the power supply unit increases the deployment readiness of the latter significantly, since there is no need to store and make ready separate corresponding conductors on the water vehicle that is to be supplied.

The on-board electrical power supply system of the water vehicle to be supplied advantageously forms the consumer load first and foremost, preferably exclusively, which makes it possible to decouple the energy supply to the water vehicle from on-board power generation devices, such as, in particular, power generators driven by on-board ship machinery, so that the machinery of the water vehicle can be taken completely out of operation. Further consumer loads, e.g. in the freight of the water vehicle, such as e.g. reefer containers, can as an option also be connected to the power supply unit. These additional consumer loads are preferably arranged on board the same water vehicle on which the power supply unit is also arranged. Particularly preferably the power supply unit is therefore equipped for supplying at least one on-board electrical power supply system of a ship during a stay in port. As the power supply unit undertakes, preferably completely, the supply to the on-board electrical power supply system of the water vehicle, in particular in port, during the stay in port the energy supply, independent of the particular circumstances of the machinery on the water vehicle, can very easily be maintained at an environmental standard determined only by the power supply unit, in particular as far as exhaust gases are concerned. The power supply unit can therefore preferably be deployed as an in-port power supply for ships, in particular seagoing ships, particularly preferably for container ships, wherein the said power supply unit preferably supplies only the on-board electrical power supply system of the (container) ship during its stay in port, and only in a secondary manner is any supply also provided to other additional consumer loads during this time. However, in principle it is also possible for the power supply unit to be carried on-board the water vehicle during its (sea) voyage, and for the on-board electrical power supply system, and/or other consumer loads on board the water vehicle to be supplied with power.

In a particularly preferred design of the power supply unit, a 40-foot container is provided as a base unit, in which are provided the generator, or generators, the engine or engines, and preferably also the necessary interface connections. Here also a drum is preferably accommodated, with a connecting cable to an on-board electrical power supply system of a (container) ship.

Two 20-foot containers, located next to one another, are provided on the 40-foot container, wherein in one of these interchangeably arranged 20-foot containers the fuel tank, preferably a gas tank for LNG, is provided, and in the other, connected securely with the 40-foot container, the so-called "gas processing unit". In a variation two smaller standard containers with the so-called "gas processing unit" are provided on either side next to the 20-foot container containing the fuel tank, so that the 20-foot container with the fuel tank is arranged centrally between the smaller standard containers.

In a further particularly preferred design of the power supply unit, a container, in particular a 40-foot container, is provided as a base unit, in which are provided the generator, or generators, the internal combustion engine, i.e. the engine or engines, and preferably also the necessary interface connections. Here a control device is also preferably accommodated for controlling the generator and/or the internal combustion engine, and/or the fuel treatment device. On the (40-foot) container forming the base unit, a further container, in particular a 20-foot container, is provided in which the fuel storage device is provided. Two further containers, each in particular 9-foot containers, are preferably arranged next to the container with the fuel storage device. In particular, both further containers are arranged on the same side of the container with the fuel storage device. In one of these two further containers a cooling device is preferably arranged, and in the other of the two further containers, means of storage for electrical conductors, in particular a cable drum, are preferably arranged. On the other side of the container with the fuel storage device a further container, in particular with a relatively narrow design, is preferably arranged, in which is advantageously arranged a connector device for transferring fuel from the at least one fuel storage device to the internal combustion engine. The dimensions of the containers, located next to one another on the (40-foot) container forming the base unit, are such that these when taken together, preferably amount to 40 feet.

The containers with the individual modules are assembled to form a single unit for handling purposes. In particular, they are to be set down as a single unit on the ship to be supplied, and from there are later to be picked up and brought onto land or onto a means of transport. The entire power unit can be lifted by crane and moved with standardised equipment (container bridge, and/or van carrier) and for purposes of operation is set down on the (container) ship in one of the container mounting fixtures that is present. This power supply unit preferably supplies only the on-board electrical power supply system of the (container) ship during the latter's stay in port.

The power supply unit is preferably designed such that it can generate at least 0.5 MW, preferably at least 0.8 MW, particularly preferably at least 1.0 MW, and most preferably at least 1.5 MW.

The power supply unit is preferably designed such that the power is generated with a voltage of 100 V to 10 kV, in particular of 300 V to 7.5 kV, particularly preferably of 200 V to 600 V, or of 5.5 kV to 7.5 kV, most preferably of 440 V, or of 6.6 kV. In particular the generator of the power supply unit can preferably be designed such that the generator generates a voltage of the above-cited level without the need for additional transformers. The power is preferably generated with a frequency of 50 Hz to 60 Hz, in particular 50 Hz or 60 Hz. In particularly preferred examples the power generated has the following performance data: 6.6 kV at 60 Hz, and 440 V at 50 Hz or 60 Hz.

The individual above-described preferred forms of embodiment can be combined with one another, unless stated otherwise.

The above-cited task is furthermore achieved in an advantageous manner by a power supply assembly comprising a plurality of power supply units in accordance with one of the above described forms of embodiment, or a combination of these forms of embodiment, wherein the power supply assembly has means of connection for electrical connection of the plurality of power supply units with one another. The means of connection are designed such that the power generated by the plurality of power supply units (100; 200) can be jointly supplied to a consumer load, in particular the on-board electrical power supply system of a water vehicle. The means of connection can, for example, be connecting cables for purposes of making an electrical connection between the power supply units, electrical switching equipment, means for the adjustment of frequency, amperage, and/or voltage of the power generated, or central supply equipment for the central supply of the total power generated by the power supply units into the consumer load, in particular an on-board electrical power supply system. The power supply assembly comprises at least two power supply units. The power supply assembly preferably comprises 2 to 10, particularly preferably 3 to 8, most preferably 3 to 5 power supply units. The power supply assembly can therefore accordingly generate more power than an individual power supply unit, wherein the cumulative power is dependent on the number of power supply units and the power of the individual power supply units. The plurality of power supply units of the power supply assembly, or at least some of these, are preferably arranged side-by-side, in particular directly adjacent to one another, in particular on board a water vehicle. A power supply assembly comprising precisely two power supply units can advantageously generate at least 1.0 MW, preferably at least 1.5 MW, particularly preferably at least 2.2 MW, and most preferably at least 2.8 MW of power.

The above-cited task is furthermore achieved in an advantageous manner by means of a water vehicle with an on-board electrical power supply system and a power supply unit and/or a power supply assembly of the above-described type, wherein the power supply unit, and/or the power supply assembly are connected with the on-board electrical power supply system for supplying electrical energy. Here the power supply unit and/or the power supply assembly are arranged on board the water vehicle.

The advantage lies in particular in the fact that, in particular for container ships in which for reasons of space no cables can be laid to a so-called "power barge", a self-contained transportable container unit made up from standard containers is provided as a power supply unit on board a ship. This container unit is preferably able to generate power on the basis of natural gas, or "LNG".

BRIEF DESCRIPTION OF THE FIGURES

Examples of embodiments of the invention are represented in the figures and are described in detail below, wherein corresponding elements in all figures are provided with the same reference symbols, and any repetitive description of these elements is omitted. Here.

PREFERRED FORM OF EMBODIMENT OF THE INVENTION

Figure 1:
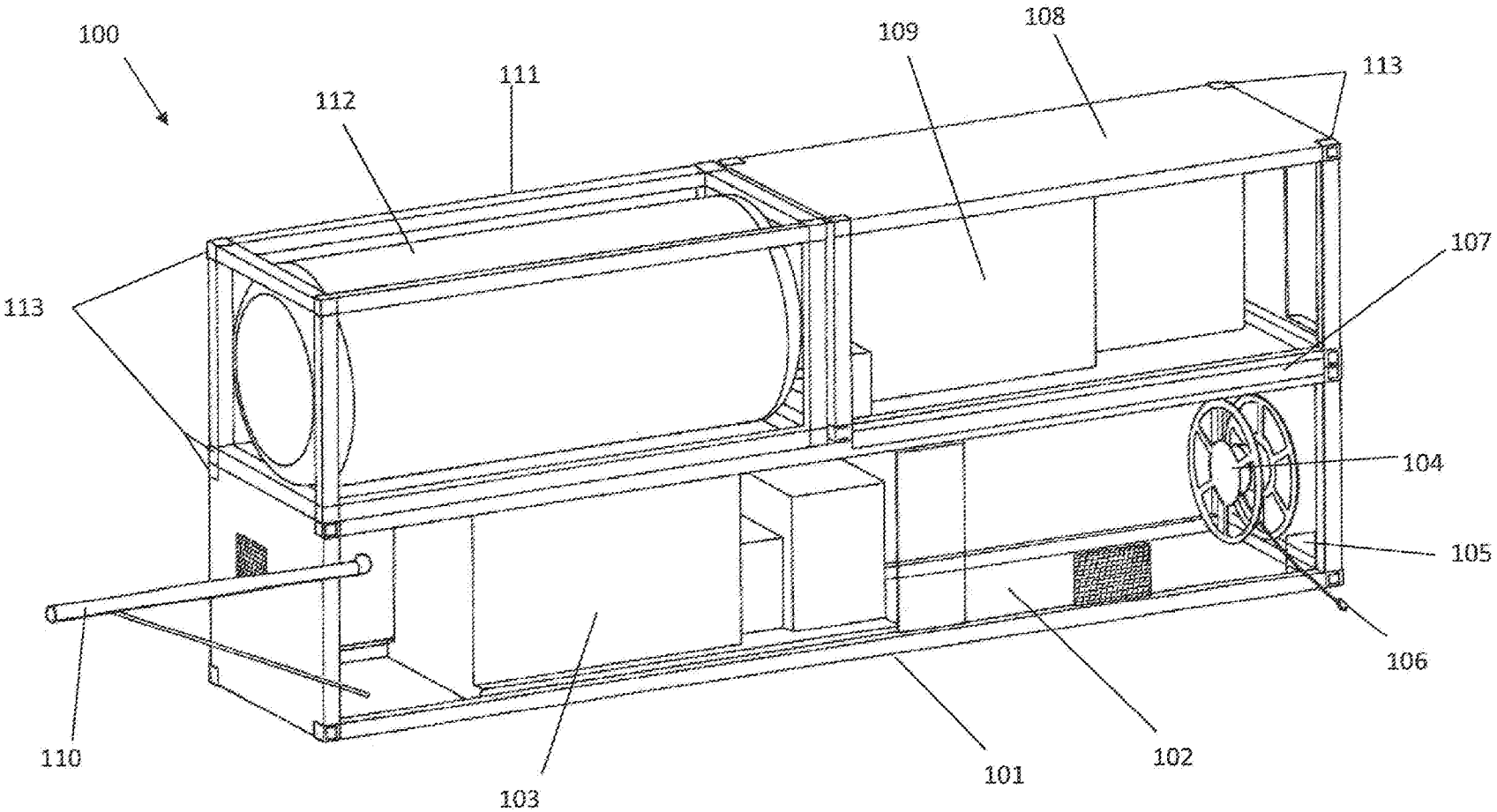
FIG. 1 shows a first example of embodiment of a power supply unit.

In FIG. 1 a first example of embodiment of a power supply unit is designated with the reference symbol 100; this is constructed from transport containers, in particular from ISO standard containers. Here a 40-foot container, i.e., an ISO standard container with a length measurement that corresponds to a first grid stowage dimension of 40 feet, forms a first compartment 102 of a first structural unit 101 of the power supply unit 100. In this first stowage region 102 are arranged an internal combustion engine and a generator for generating power which can be driven by the internal combustion engine; in FIG. 1 these are very schematically indicated as a generator set, and are designated with the reference symbol 103. Furthermore a cable drum 104 is arranged in the first compartment 102 of the power supply unit 100, together with a connecting cable 106, which can be led out of the first compartment 102 through a cable opening 105, which can preferably be closed; via this cable electrical energy from the power supply unit 100 can be outputted to a consumer load.

Positioned on top of the first compartment 102 of the first structural unit 101 of the power supply unit 100 and securely connected with the latter, here e.g. by means of welded-on brackets or connecting plates 107, is a 20-foot container 108, which forms a second compartment of the first structural unit 101. Optionally the 20-foot container 108 can also be bolted or riveted to the 40-foot container 102, or can be connected by other similar means of connection that are of a similar type or operate in a similar manner, however, this connection is not detached when the power supply unit 100 is in operation, or during transport and handling of the latter. In this second compartment 108 is arranged a very schematically indicated so-called "gas processing unit" 109.

Other components of the power supply unit 100, such as e.g. control devices, can be provided in the first structural unit 101, but are not represented here in the interests of clarity. Similarly not represented are operative connections between the components of the power supply unit 100, which run within the first structural unit 101, such as e.g. electrical cables or fuel lines; these are preferably permanently installed and also cannot be disconnected in operation. An example of a very schematically represented exhaust gas duct is designated with the reference symbol 110; this is preferably configured such that it can be retracted or removed.

Similarly positioned on top of the first compartment 102 of the first structural unit 101 of the power supply unit 100, and not securely connected with the latter, but rather detachably docked, is a further 20-foot container, which forms a second structural unit 111. In this second structural unit 111 is installed a fuel tank, preferably a gas tank 112 for storing liquefied natural gas, the so-called LNG. When docking the second structural unit 111 onto the first structural unit 101, in addition to the mechanical connections, a duct connection is also made for supplying gas to the generator set 103, in particular to the "gas processing unit" 109. The mechanical connections are preferably formed by means of standardised connecting elements of the containers, in particular by the standardised container corners 113 and locking devices that are usual in the case of ISO containers, wherein these are preferably arranged on the upper face of the first structural unit 101. Other connections that can be detached are also possible. The configuration of the mechanical connections by means of the standardised connecting elements enables not only simple docking and detachment, but also offers sufficient mechanical stability in order e.g. to move the whole power supply unit 100 including the gas tank 112 by means of a container bridge or a van carrier as one item without any problems.

Figure 2:
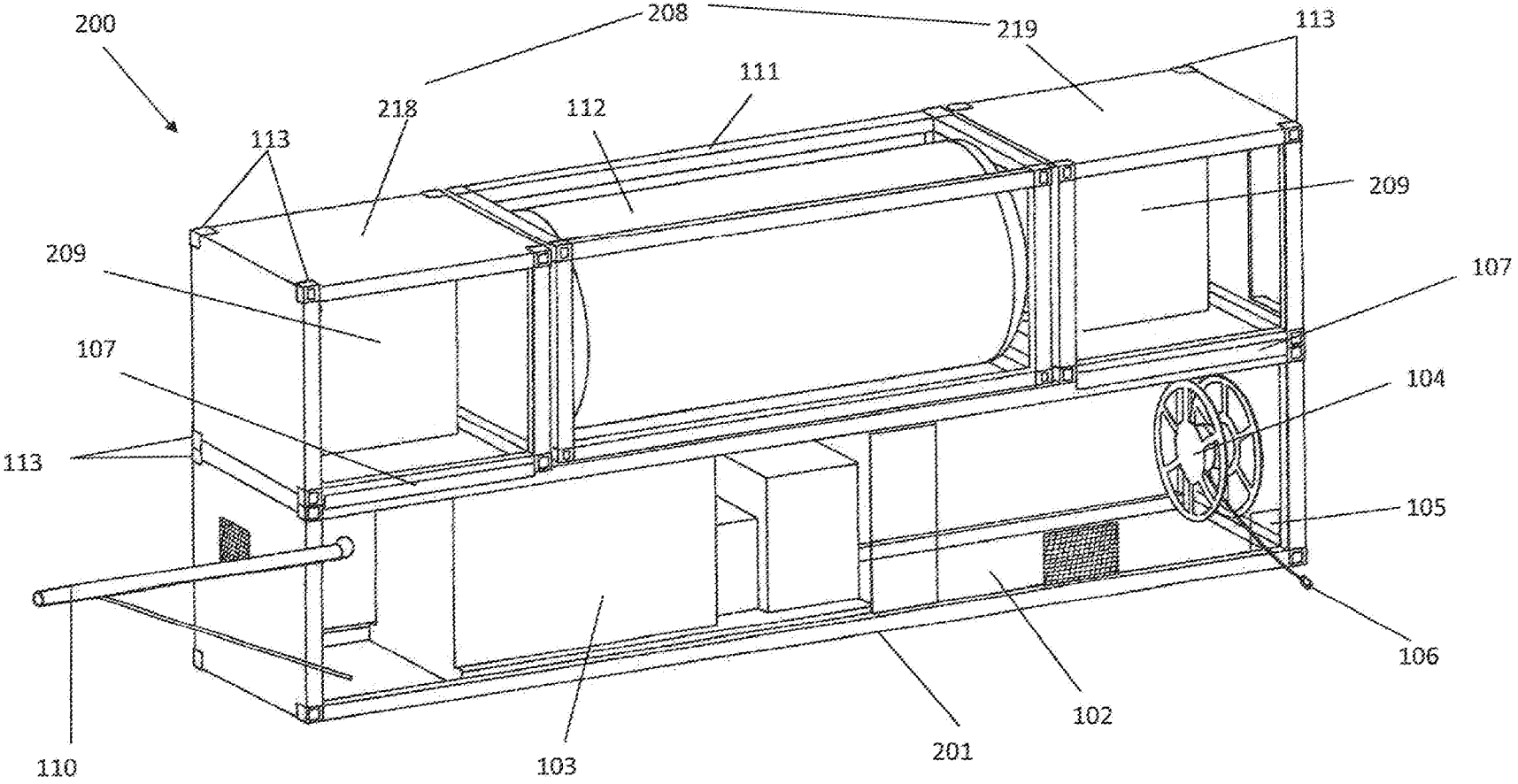
FIG. 2 shows a second example of embodiment of a power supply unit.

FIG. 2 shows, in a variation of FIG. 1, a second example of embodiment of a power supply unit, which is identified with the reference symbol 200. This has a first structural unit 201, with a second compartment 208, which compared with the first example of embodiment in FIG. 1 now consists of a first and a second subcompartment 218 and 219 respectively, whereas the first compartment 102, together with the second structural unit 111 with its components, remains unaltered compared with the example in FIG. 1. The "gas processing unit", now designated with the reference symbol 209, can optionally be located in the first subcompartment 218 or in the second subcompartment 219, or is installed in a distributed manner across the subcompartments 218, 219. One or both subcompartments 218, 219 optionally also contain control devices, not represented in FIG. 2, for the power supply unit 200.

In the example of embodiment of the power supply unit 200 the second structural unit 111 with the gas tank 112 is positioned on top of the first compartment 102 of the first structural unit 201 in the gap between the subcompartments 218, 219, i.e. it is docked on the first compartment 102 of the first structural unit 201. Apart from a spatially offset arrangement of components that are required, and/or provided for this example, such as locking devices and a fuel input socket, this is identical to the example in FIG. 1. The advantage of the arrangement in FIG. 2 lies in the fact that, if required, one or a plurality of freight containers can be placed on top of the subcompartments 218, 219, e.g. a container with the same grid stowage dimension as that of the first compartment 102 of the first structural unit 201, i.e. with the first grid stowage dimension. In a preferred, but not exclusive, example the said first grid stowage dimension is 40 feet, the second grid stowage dimension of the second structural unit 211 is 20 feet and the subcompartments 218, 219 have a fourth and a fifth grid dimension of 10 feet in each case.

Figure 3:
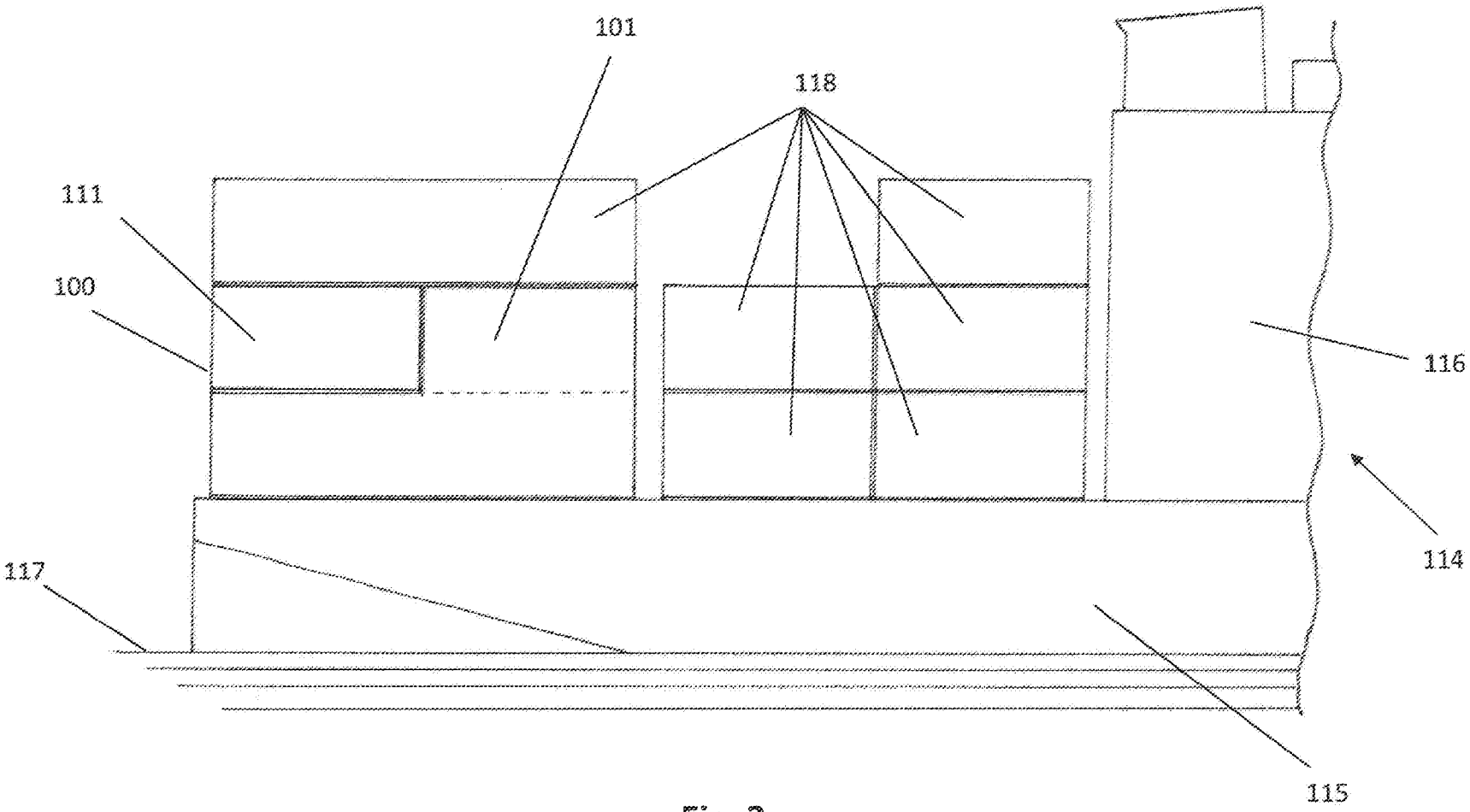
FIG. 3 shows a very schematic representation of the deployment of a power supply unit, in accordance with the example of embodiment in FIG. 1, on the deck of a container ship.

FIG. 3 shows a highly schematic representation of a deployment of a power supply unit 100 in accordance with the example of embodiment in FIG. 1 on the afterdeck of a container ship 114, the hull 115 and deckhouse 116 of which are indicated in outline. A water level is designated with the reference symbol 117, e.g. a water level in a port basin, in which the container ship has moored for handling cargo, i.e. for loading and unloading freight containers 118, which serve to convey freight in the usual manner. The power supply unit 100 has been set down as a self-contained unit on the afterdeck of the container ship 114, on or alongside the ship's cargo consisting of freight containers 118, and there has been electrically connected to an on-board electrical power supply system, not represented, of the container ship 114. Although the power supply unit 100 occupies a freight container site on, or, on occasions, even under the deck of the container ship, this does not significantly impair the loading and unloading activity. After completion of the loading and unloading activity the power supply unit 100 is removed once more from the container ship 114 and set down, e.g. on the quay. There it can similarly, insofar as this is required, be stacked together with other standardised freight containers; also a plurality of power supply units 100 can be stored in readiness on the quay one upon another in a space-saving manner.

Figure 4:
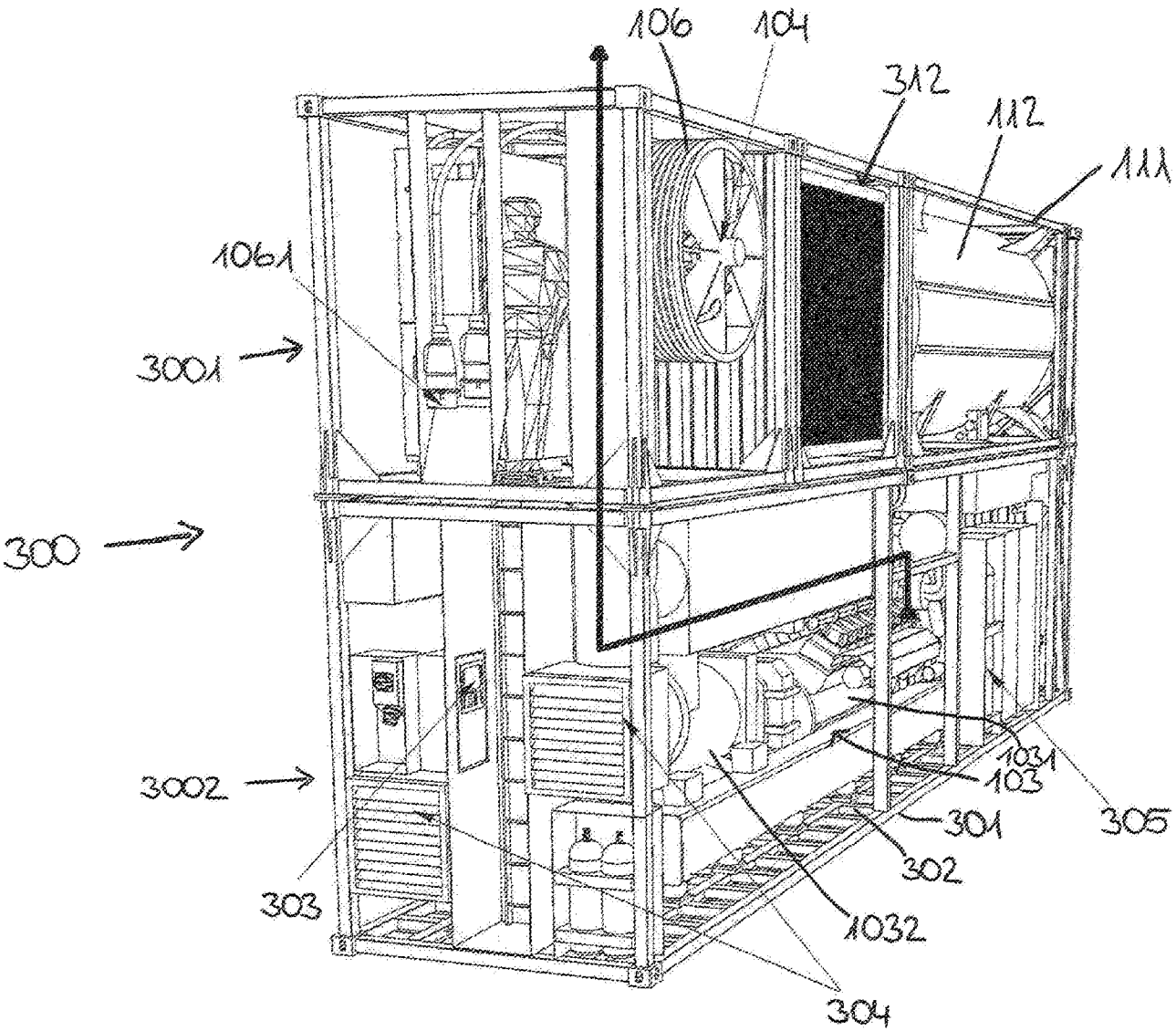
FIG. 4 shows a perspective view of a third example of embodiment of a power supply unit.
Figure 5:
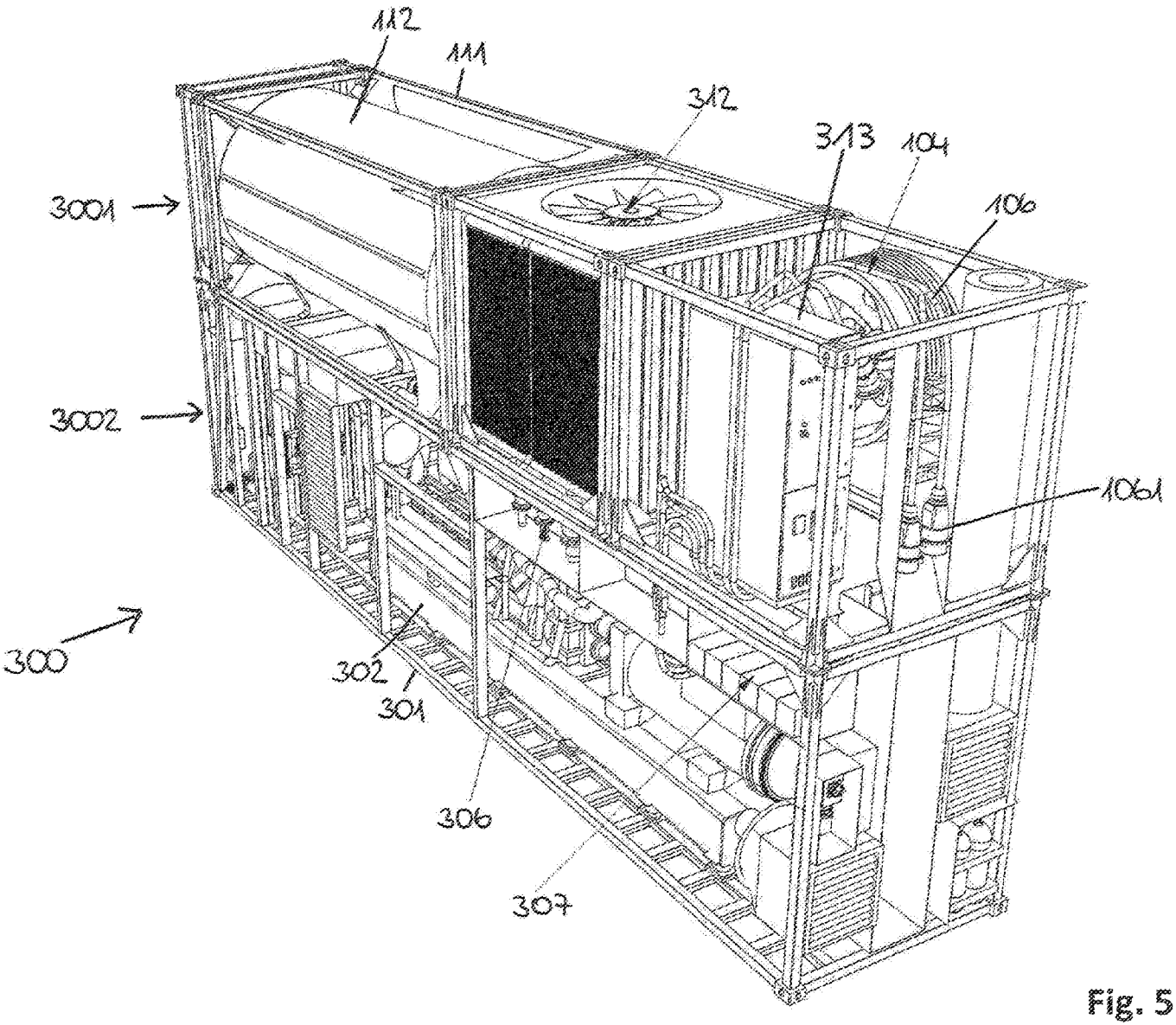
FIG. 5 shows a further perspective view of the example of embodiment in FIG. 4.
Figure 6:
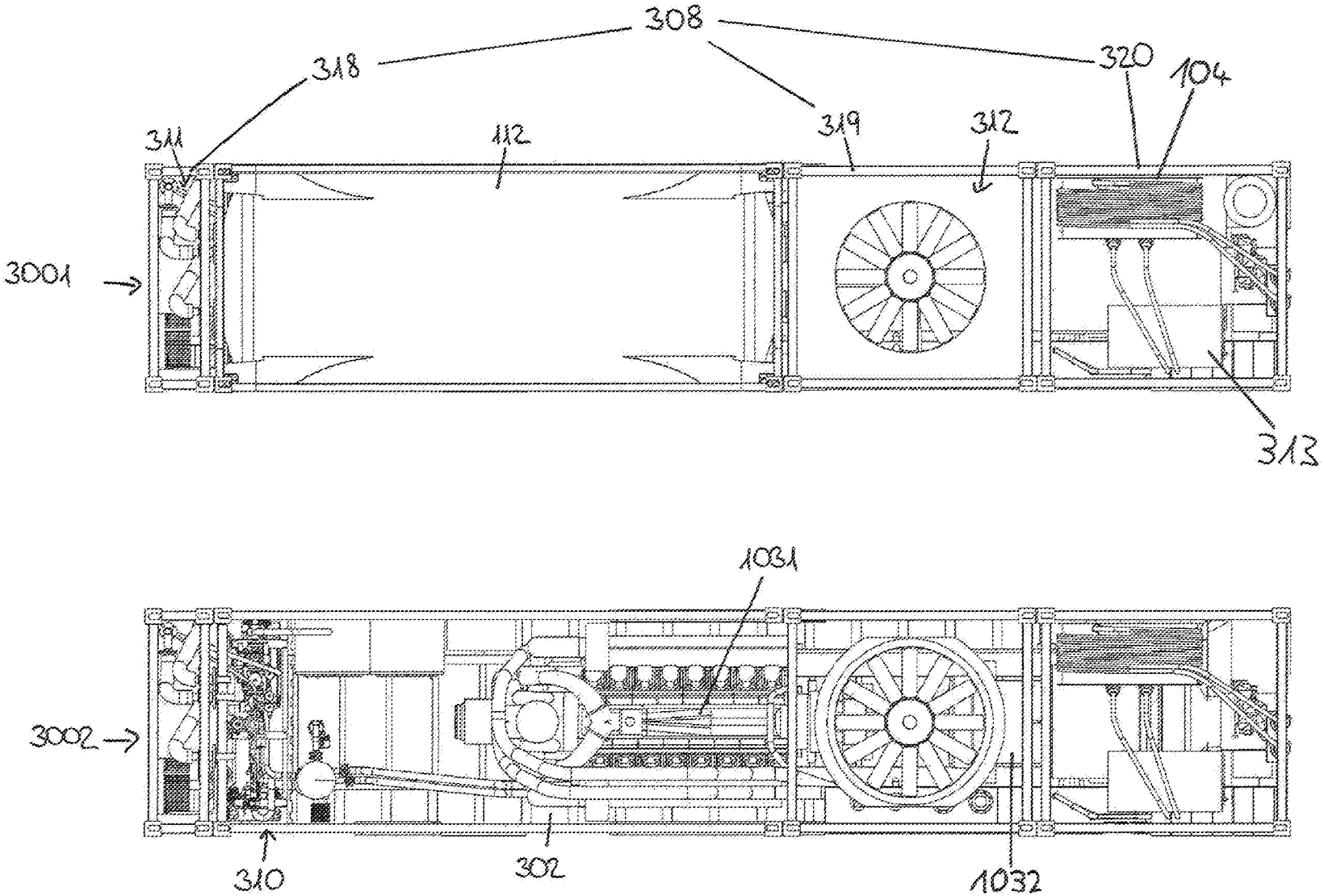
FIG. 6 shows a plan view onto the containers of the example of embodiment in FIG. 4.
Figure 7:
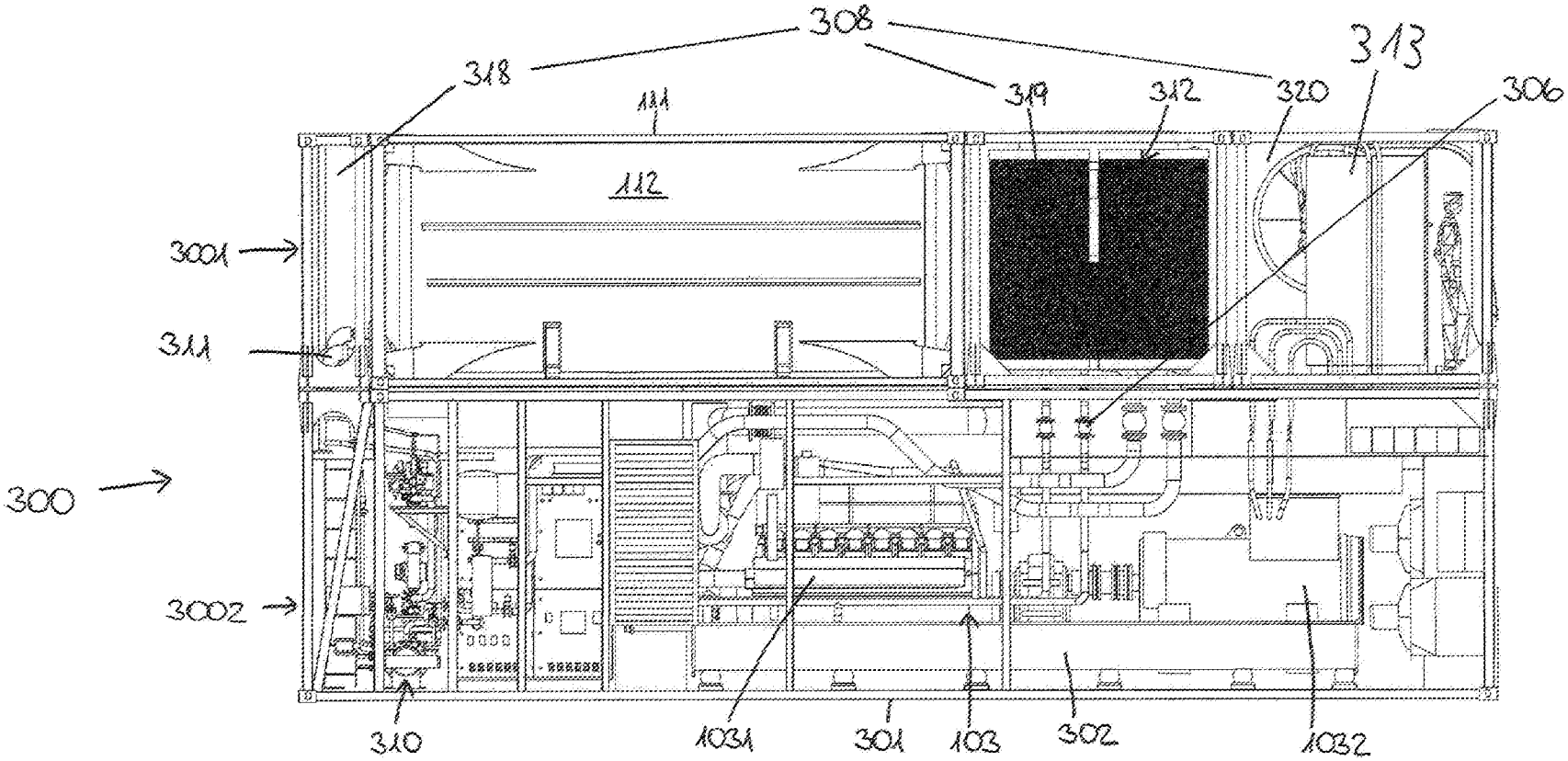
FIG. 7 shows a side view of the example of embodiment in FIG. 4.

In FIGS. 4 to 7 a further example of embodiment of a power supply unit 300 is represented. FIGS. 4 and 5 show views in perspective, and FIG. 7 shows a side view. In the example of embodiment two storeys 3001, 2002 of transport containers are arranged one above another, which together form the power supply unit 300. In FIG. 6 a plan view is presented in each case, onto the upper container storey 3001, and onto the lower container storey 3002. The two container storeys 3001, 3002 are located laterally flush with one another, i.e. they have essentially the same total length.

The power supply unit 300 is constructed from transport containers, in particular at least in part from ISO standard containers. Here an individual container, which can, for example, be designed as a 40-foot container, i.e., as an ISO standard container with a length measurement that corresponds to a first grid stowage dimension of 40 feet, forms a first compartment 302 of a first structural unit 301 of the power supply unit 300. In this first compartment 302 are arranged an internal combustion engine 1031 and a generator 1032 for generating power which can be driven by the internal combustion engine 1031; together these form a generator set 103. Furthermore, in the first compartment 302 of the power supply unit 300 there are arranged an operating unit 303 for operating the power supply unit by a user, air supply devices 304 for the supply of (fresh) air to the first compartment 302, fire-extinguishing equipment 305 in the form of $CO_2$ bottles, cooling water interface connections 306, batteries 307 for the intermediate storage of power for supply to a control device, and/or for purposes of starting the power supply unit 300, and a fuel treatment device 310. By means of a fuel treatment device, the fuel can be treated for supply to the internal combustion engine. In particular by this means liquefied gas, in particular LNG, can be converted into the gaseous state, before it is supplied to the internal combustion engine.

Furthermore, the first structural unit 301 has a second compartment 308, consisting of first, second and third subcompartments 318, 319, 320. In the first subcompartment 318 is connector device 311, preferably designed in the form of a coupling, for the purpose of transferring fuel from a fuel storage device to the first structural unit 301. The first subcompartment 318 is arranged above the fuel treatment device 310, and the hoses featured in the connector device 311 run downwards into the first compartment 302 to the fuel treatment device 310 (see in particular FIG. 7). As a result the hose length required is relatively short. The second subcompartment 319 comprises a cooling device 312 for cooling the internal combustion engine 1031. The cooling device can, for example, comprise a condenser, a fan, and/or a coolant circuit. The third subcompartment 320 comprises a means of storage for electrical cables. In the present example the means of storage comprise a cable drum 104 with two connecting cables 106, arranged on top of the drum, which can be led out of the first compartment 302; from the power supply unit 100 electrical energy can be outputted via these cables to a consumer load. Connectors 1061 are provided at one end of the connecting cables 106; via these the connecting cables 106 can be connected to a consumer load, or to other cables 106. Moreover, in the third subcompartment 320 power switches designed as circuit breakers are provided in a control cabinet 313. The three subcompartments 318, 319, 320 are in each case formed by individual transport containers, which are securely connected with the container forming the first compartment 302. Likewise, the two containers of subcompartments 319 and 320 can be securely connected with one another. The two subcompartments 319, 320 could also be provided within one transport container.

In the example of embodiment of the power supply unit 300 the second structural unit 111 with the gas tank 112 is positioned on top of the first compartment 302 of the first structural unit 301 in the gap between the subcompartments 318 on the one side, and the two subcompartments 319 and 320 on the other side, wherein the second structural unit 111 is laterally bounded by the first subcompartment 318 and the second subcompartment 319. In the present example the second structural unit 111 is detachably connected with the first structural unit 301 and docked onto the latter by means of locking devices, not represented, in particular so-called "twist locks". By this means a second structural unit 111 with an empty gas tank 112 can easily be replaced with another second structural unit (not represented here) with a full gas tank.

Taken together with the second structural unit 111, the containers of the second compartment 308 have the same grid stowage dimension as the containers of the first compartment 302. Furthermore, the two containers of subcompartments 319 and 320 can each have the same grid stowage dimension. In a preferred, but not exclusive, example the first grid stowage dimension of the first compartment 302 is 40 feet, the second grid stowage dimension of the second structural unit 211 is 20 feet, the fourth and fifth grid stowage dimensions of the subcompartments 319 and 320 are 9 feet, and the sixth grid stowage dimension of the subcompartment 318 is 2 feet.

The invention claimed is:

1. A transportable, compact power supply unit for supplying electrical energy to an on-board electrical power supply system of a water vehicle, the unit being configured for arrangement on the water vehicle, the unit being in a plurality of transport containers that are able to be connected together and transported as a single, coherent unit, the power supply unit comprising;

at least one internal combustion engine, which is able to be operated on natural gas, at least one generator for generating power which is able to be driven by the at least one internal combustion engine, at least one control device for the at least one internal combustion engine, and/or at least one control device for the at least one generator, at least one fuel treatment device for the at least one internal combustion engine, and at least one exhaust gas cleaning device for the at least one internal combustion engine, at least one fuel storage device, wherein the fuel of the fuel storage device is a natural gas, a first structural unit forming a fixed unit, and a second structural unit forming a further fixed unit, wherein the first structural unit contains the at least one internal combustion engine, the at least one generator for generating power which is able to be driven by the at least one internal combustion engine, the at least one control device for the at least one internal combustion engine, and/or the at least one control device for the at least one generator, and the at least one fuel treatment device for the at least one internal combustion engine, and the at least one exhaust gas cleaning device for the at least one internal combustion engine;

the second structural unit contains the at least one fuel storage device, wherein the first structural unit and the second structural unit are able to be docked onto one another so as to be arranged adjacent to each other and detached from one another, and wherein the first structural unit and the second structural unit are each arranged in a transport container of the plurality of transport containers or in a plurality of the plurality of transport containers;

wherein the structural units, both individually, and also when both are docked together, are configured with predetermined grid stowage dimensions of standardised transport containers, wherein said predetermined grid stowage are dimensions of ISO transport containers, wherein the structural units cannot be further disassembled in a modular manner for operation, transport and handling and always form a single fixed, unaltered unit for operation, transport and handling;

wherein the first structural unit comprises a first compartment, which has the configuration of a standardised transport container with a length dimension that corresponds to a first grid stowage dimension, and in which are arranged at least the at least one internal combustion engine and the at least one generator for generating power is able to be driven by the at least one internal combustion engine;

wherein the first structural unit comprises a second compartment, which has the configuration of a standardised transport container with a length dimension that corresponds to a third grid dimension, and in which is arranged at least the at least one fuel treatment device, and the at least one exhaust cleaning device for the at least one internal combustion engine, and/or a cooling device for cooling the internal combustion engine, and/or a storage means of storage for electrical conductors;

wherein the second structural unit has the configuration of a standardised transport container with a length dimension that corresponds to a second grid stowage dimension;

wherein the first and the second compartments of the first structural unit are connected with one another so as to be arranged adjacent to each other, forming a fixed unit wherein the first and the second compartments cannot be further disassembled in a modular manner for transport, handling and operation;

wherein the second compartment is arranged above the first compartment;

wherein the second structural unit is able to be arranged alongside the second compartment of the first structural unit, and wherein the sum of the second grid stowage dimension and the third grid dimension is less than or equal to the first grid stowage dimension; and wherein a connector device, which is pluggable, is provided for transferring fuel from the at least one fuel storage device of the second structural unit to the first structural unit, wherein the pluggable connector device is designed for the at least semi-automatic establishing of a connection for the transfer of fuel when the second structural unit is docked onto the first structural unit.

2. The power supply unit in accordance with claim 1, wherein the first structural unit comprises a second compartment subdivided into two or a plurality of subcompartments, wherein each of the subcompartments has the configuration of a standardised transport container with a length dimension that corresponds to a fourth, fifth, and/or sixth grid dimension, and wherein in at least one of the subcompartments is arranged at least the at least one fuel treatment device, and/or the at least one exhaust cleaning device for the at least one internal combustion engine, and/or a cooling device for cooling the internal combustion engine, and/or a storage means for electrical conductors.

3. The power supply unit in accordance with claim 2, wherein the first compartment and the subcompartments of the second compartment of the first structural unit connected with one another, forming a fixed unit.

4. The power supply unit in accordance with claim 2, wherein the subcompartments of the second compartment are arranged above the first compartment.

5. The power supply unit in accordance with claim 2, wherein the second structural unit is able to be arranged between the subcompartments of the second compartment of the first structural unit, and wherein the sum of the second, fourth and fifth grid stowage dimensions is less than, or equal to, the first grid stowage dimension.

6. The power supply unit in accordance with claim 1, wherein fuel is able to be supplied exclusively from the fuel storage device to the at least one internal combustion engine.

7. The power supply unit in accordance with claim 1, electrical connection means for connecting the power supply unit at least with an on-board electrical power supply system of the water vehicle that is to be supplied, forming a consumer load for the electrical energy generated by the power supply unit, wherein the electrical connection means are arranged in the first structural unit.

8. The power supply unit in accordance with claim 1, wherein the power supply unit is configured for supplying at least one on-board electrical power supply system of a water vehicle during a stay in port.

9. A power supply assembly, comprising a plurality of power supply units in accordance with claim 1, wherein the power supply assembly has connection means for electrically connecting the plurality of power supply units with one another, such that the power generated by the plurality of power supply units is able to be jointly supplied to the on-board electrical power supply system of a water vehicle wherein the on-board electrical power supply system forms a consumer load.

10. A water vehicle with an on-board electrical power supply system and a power supply assembly in accordance with claim 9, wherein the power supply assembly is connected with the on-board electrical power supply system for supplying electrical energy.

11. A water vehicle with an on-board electrical power supply system and a power supply unit in accordance with claim 1, wherein the power supply unit connected with the on-board electrical power supply system for supplying electrical energy.

12. The power supply unit in accordance with claim 1, wherein the natural gas is a liquefied gas.

* * * * *